United States Patent [19]

Maier et al.

[11] Patent Number: 4,640,051

[45] Date of Patent: Feb. 3, 1987

[54] ADJUSTMENT MECHANISM FOR TILTABLE GLAZED SASHES

[75] Inventors: Helmut Maier, Leinfelden-Echterdingen; Ralf Storandt, Leonberg; Heinz Guenther, deceased, late of Leonberg; by Renate Guenther, legal representative, Stuttgart; by Sabine Guenther, legal representative, Neuenbürg, all of Fed. Rep. of Germany

[73] Assignee: Geze GmbH, Fed. Rep. of Germany

[21] Appl. No.: 690,638

[22] Filed: Jan. 11, 1985

[30] Foreign Application Priority Data

Jan. 12, 1984 [DE] Fed. Rep. of Germany ..... 3400778

[51] Int. Cl.[4] ..... E05F 11/24

[52] U.S. Cl. ..... 49/348; 74/412 TA; 464/36

[58] Field of Search ..... 49/341, 343; 74/412 TA; 464/36, 39

[56] References Cited

U.S. PATENT DOCUMENTS

| | | | |
|---|---|---|---|
| 2,114,645 | 4/1938 | Van Benschoten | 49/341 X |
| 2,355,932 | 8/1944 | Walton | 49/341 X |
| 2,585,122 | 2/1952 | Hartman | 49/343 |
| 2,636,727 | 4/1953 | Toth | 49/343 X |
| 3,119,247 | 1/1964 | Grabovac | 464/36 |
| 3,250,038 | 5/1966 | Steel | 49/341 |
| 4,214,459 | 7/1980 | Leitner | 464/36 |

*Primary Examiner*—Philip G. Kannan

[57] ABSTRACT

The mechanism of the invention can be mounted on and in contact with a frame. A spindle (2) is disposed within a shallow strip-like housing (1) parallel to an edge of a glazed sash of a window or door and a slider (3) displaceable on rotation of the spindle (2) is mounted on the spindle in order to drive a latching and/or deployment device for the glazed sash. The spindle can be adjusted by means of a knob-like handle (4) which is drivingly connected with the spindle (2) via gears (5, 6). A safety coupling (15 to 23) which limits the maximum achievable positioning force is arranged inside the handle (4).

8 Claims, 3 Drawing Figures

ADJUSTMENT MECHANISM FOR TILTABLE GLAZED SASHES

Figure 2:
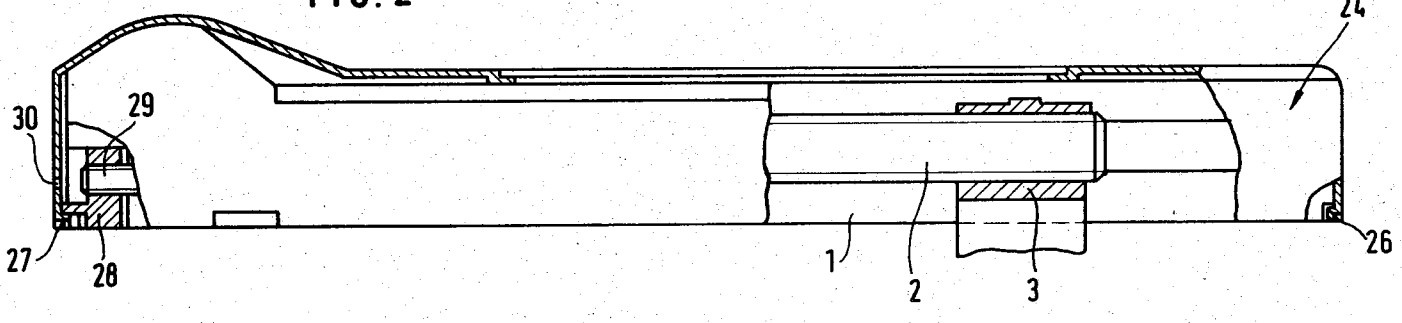

The invention relates to an adjustment mechanism for tiltable glazed sashes of windows and doors, the adjustment mechanism comprising a rotatable handle which drives, via an overload coupling, a spindle, and a displaceable slider which is arranged thereon, wherein said displaceable slider is in turn coupled to said tiltable glazed sash to tilt the same.

Such adjustment mechanisms are frequently found in so-called tilt and turn fittings which enable a window or door to be selectively tilted inwardly in a vertical plane about a horizontal pivot axis or to be swung inwardly about a vertical axis.

In an arrangement of this kind the handle may be a crank handle and, when inward tilting is selected, the slider is connected to drive the glazed sash to the desired open position, for example by way of a positioning linkage with a locking and/or deployment device, in particular with locking pegs and a scissor linkage for deployment.

Such twist and turn fittings are normally provided for very heavy glazed sashes, for example for window sashes with bullet-proof glazing because in this case an actively driven deployment device is necessary in order to tilt the window sash, so as to prevent the window sash falling with a bang from its closed position into the tilted open position after unlocking the window.

In such known twist and turn fittings the adjustment mechanism is housed inside a groove or rabbet of a frame part, as a rule of the glazed sash. Accordingly the aforementioned groove must have a large cross-section, i.e. the inbuilt dimensions of the adjustment mechanism must be taken into account when designing the frame sections, so that the adjustment mechanism can only be combined with particular frames.

The problem underlying the invention is to provide an adjustment mechanism or transmission for a tiltable fitting which, in contrast to previous constructions, can be mounted on practically any frame.

This problem is solved in that the spindle is arranged parallel to an edge of said glazed sash in a housing mounted on a frame part associated with said glazed sash; in that said rotatable handle is a knob-like handle; and in that said overload coupling is arranged inside said knob-like handle.

Thus, in accordance with the invention, the adjustment mechanism is mounted on and in contact with a frame part so that it is not necessary to provide any form of free space within the frame parts for the mechanism. Only the positioning rods or the like which are of small cross-section need to be housed in the frame. Accordingly, the adjustment mechanism of the invention is also suitable for mounting on wooden frames. The latter are admittedly as a rule usually used for less heavy glazed sashes, which from the point of view of their weight do not necessarily require and active opening arrangement which necessarily produces movement on actuating the handle. Nevertheless such adjustment mechanisms can advantageously be used with wooden framed sashes, in order for example to immovably hold the glazed sash in any desired opened and tilted position and accordingly to prevent movements of the glazed sash due to the effects of wind or the like.

The adjustment mechanism of the invention is characterised by its extremely small space requirement in as much as the housing need only be dimensioned so that it covers the spindle and can thus have a strip-like shallow appearance. The knob-like handle offers, on the one hand, adequate space for the overload coupling, and on the other hand, with windows which can also be opened by rotating them about a vertical axis, acts as a grip for opening the glazed sash for cleaning purposes. In this way the hand grips which are normally mounted on the glazed sash in conjunction with known tilt and turn fittings are no longer necessary.

In accordance with a preferred embodiment of the invention an outwardly pivotable crank handle is mounted on the knob-like handle and facilitates actuation of the handle when a large adjustment of the position of the glazed sash is to be effected. For smaller adjustments of the selected position of the window the knob-like handle can however be actuated directly without making use of the outwardly pivotable crank handle. In this connection it is advantageous for the grip of the inwardly pivoted crank handle to project somewhat beyond the knob-like handle at the side facing the glazed sash in order to prevent slipping of the hand used to actuate the handle.

When the knob-like handle has an axis of rotation which is inclined towards the central region of the glazed sash in such a way that the contour of the knob-like handle is disposed, when viewed at right angles to the plane of the glazed sash, on the side of the housing facing towards the central region of the glazed sash, the contour of the handle does not project over the side of the housing facing towards the outer edge of the sash. In this way the housing can also be arranged particularly close to the outer edge of the door or window frame and also in the corner regions which adjoin the frame.

The knob-like handle is preferably arranged at one end of said housing adjacent an end face of the spindle, i.e. asymmetrically, so that the knob can be attached, for example when the housing is mounted in the preferred manner on a horizontal frame part of the glazed sash close to a corner of the frame remote from the vertical axis of rotation of the same, practically directly at the named corner of the frame which facilitates eventual opening of the glazed sash by swinging it inwardly about the vertical axis of rotation during which the knob can be used as grip.

In other respects a corresponding arrangement of the adjustment mechanism on the vertical frame part of the glazed sash is also possible and advantageous because in the case it may be possible to do away with positioning rod parts which have to be guided around the frame corner adjacent the knob-like handle.

A comparatively simple construction for the adjustment mechanism is obtained is a gear wheel, which is rotatably fixedly connected with the spindle on the spindle axis, meshes with a further gear wheel which is rotatably journalled in the housing, and if the knob-like handle is rotatably journalled on a stub-like axle element which is rotatably fixedly connected with said further gear wheel and which is drivingly connected with the knob-like handle by means of a latch mechanism which is provided as the overload coupling. Moreover, the housing can be made particularly compact because the knob-like handle does not require any special bearing parts at the housing. Furthermore, this construction also favours an arrangement with a removable handle which make unauthorised adjustment of the window or the like more difficult by permitting optional removal of the handle.

The axle element, which is constructed as a hollow sleeve, can accommodate a coil spring which is provided as a latch spring and which is braced againt an annular step in said sleeve and biased against a plate part which is axially displaceable and non-rotatably arranged relative to the axle element by an arrangement in which a region of the plate part which surrounds the axle element in ring-like manner is connected, via web parts which extend through axial slots provided in the sleeve, with a region of the plate part which is disposed inside the sleeve and which forms the movable abutment for the spring. With this arrangement latch elements are conveniently arranged on the ring-like region of the plate part, with the latch elements cooperating with counter-elements on the knob-like handle or on a part connected therewith.

With this arrangement the latch device can, if desired, transmit relatively large torques even with a weak latch spring because the latch elements can be arranged at a relatively large radial distance from the axis of the knob-like handle. At the same time, the space inside the handle is ideally exploited.

Latch recesses are preferably provided as latch elements, with the latch recesses cooperating with balls which are arranged in recesses of an annular part constructed as a ball cage, with the annular part being rotatably arranged in the knob-like handle.

With this arrangement the balls can be biased against a counter-pressure plate which is held on the axle element to axially secure the knob-like handle. If the latch device has to release, for example when an attempt is made to turn the handle although the glazed sash has reached its end position, then the balls cooperate with the counter-pressure plate and also with the ring-like region of the plate part in the manner of an axial ball bearing so that only low sliding friction occurs because the balls roll off on the counter-pressure plate or on the ring-like region of the plate part. Accordingly friction has little effect on the latching resistance of the latch device and is predominantly predetermined by the bias of the latch spring.

The further gear wheel can be radially journalled, by means of a central bore which extends therethrough, on a bolt arranged in the housing and also, at its side facing the axle element, by means of a circular thickened portion which runs in a housing bore. In this way it is possible to provide both the axle part and the knob-like handle arranged thereon with a large area and stable support at the housing.

Figure 1:
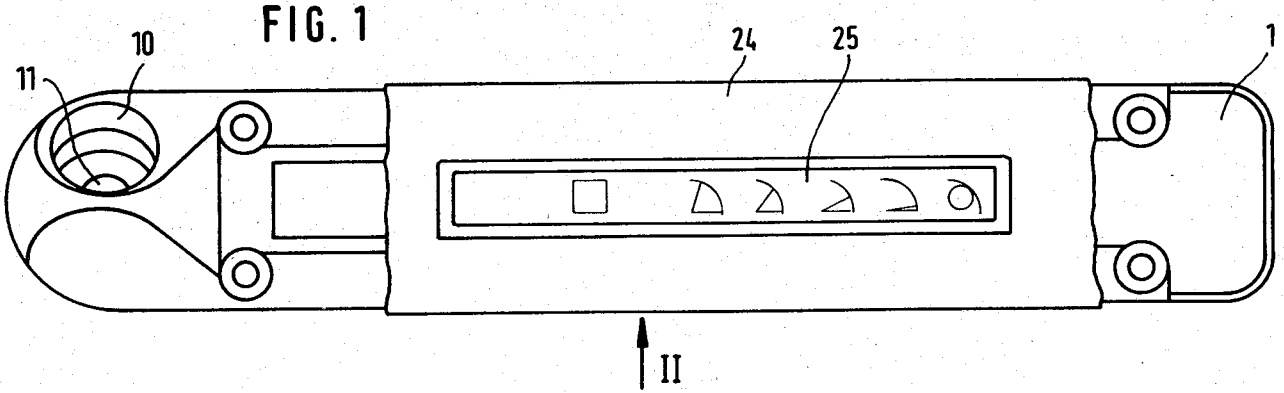

Further advantageous features of the invention are the subject of the appended patent claims and will subsequently be explained in the following with reference to the drawings in which a particularly preferred embodiment of the invention is shown. The drawings show:

FIG. 1 a plan view of the housing of an adjustment mechanism,

FIG. 2 a side view of the same in accordance with the arrow II in FIG. 1, and

Figure 3:
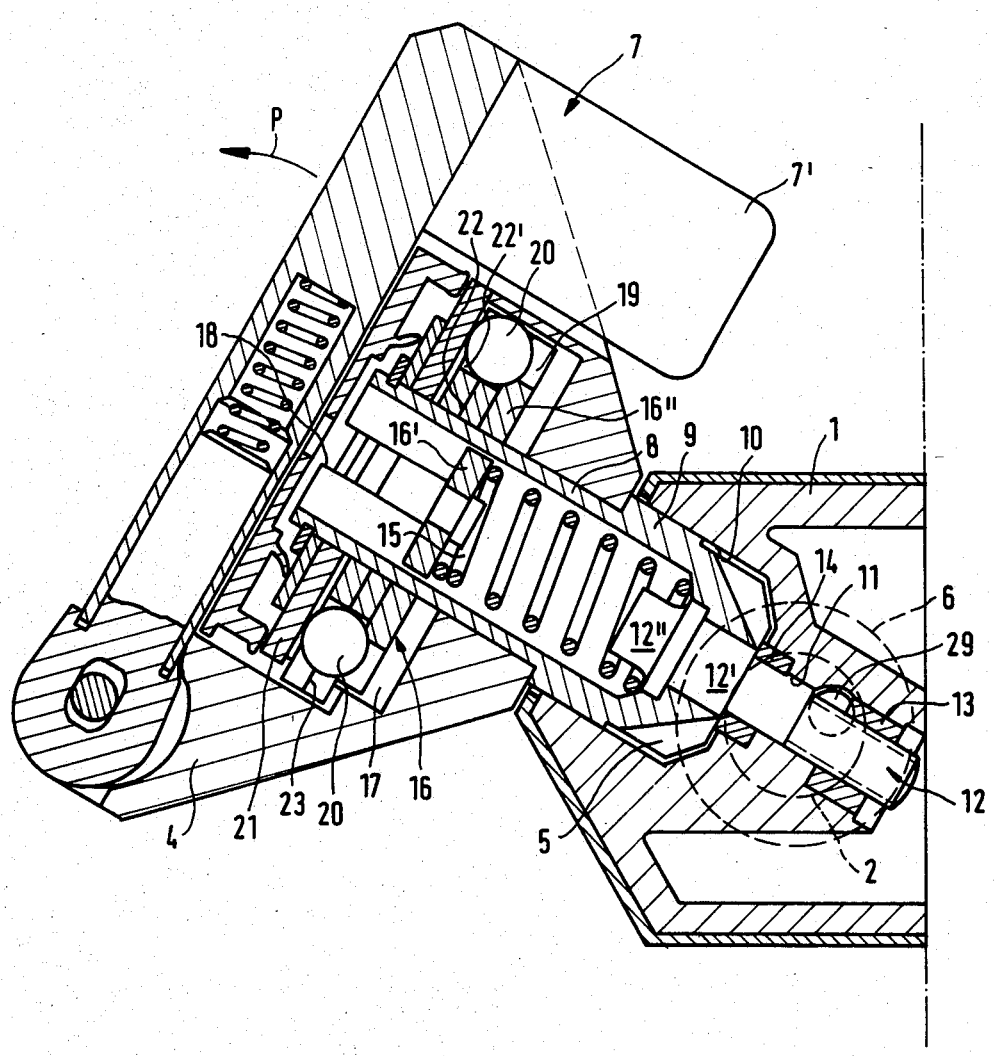

FIG. 3 a sectional view of the housing and also of the knob-like handle in a transverse plane of the housing which includes the axis of the handle.

As seen in the drawings a spindle 2 is arranged in a strip-like shallow housing 1 which can be mounted on a frame part of a glazed door or window sash or, optionally, on a fixed frame part of the door or window. The spindle 2 extends in the longitudinal direction of the housing and a slider 3 which is displaceable on rotation of the spindle is arranged on the spindle. the slider 3 serves to drive a positioning or deployment linkage and a scissor-like deployment linkage for the glazed sash which is drivingly coupled thereto, with the slider 3 being guided for sliding movement in fixed guides of the housing.

A knob-like handle 4 serves to drive the spindle 2 and is arranged at the end face of the spindle 2 at an end region of the housing 1 with a roof-like cross-section, with the axis of the knob-like handle being inclined towards the center region of the glazed sash. The handle 4 is coupled with a bevel gear 5 which is arranged coaxial to the handle 4 and which meshes with a bevel gear 6 arranged at the adjacent end face of the spindle 2.

A crank handle 7 which can be pivoted outwardly in the direction of the arrow P is mounted on the handle 4 and facilitates the actuation of the handle 4, in particular when the handle 4 has to be rotated several times. The handle 4 can however optionally be directly actuated with the crank handle pivoted inwardly, in particular for adjustments through a relatively small angle, and in this case the grip 7' of the crank handle 7 which projects beyond the side of the handle facing the plane of the glazed sash prevents slipping of the hand used to actuate the knob-like handle 4.

The bevel gear wheel 5 extends into an axle or shaft element 8 which is constructed as a sleeve-like part together with the bevel gear 5. An annular thickened portion 9 is disposed between the bevel gear 5 and the shaft part 8. This thickened portion 9 serves to seal a housing bore 10 which accommodates the bevel gear 5 against the outside, with the thickened portion 9 also serving to radially journal the bevel gear 5 in the housing bore 10.

In order to permit cooperation of the bevel gears 5 and 6 the housing bore 10 has an opening, which is not visible in the drawing, in the region of its peripheral wall.

In other respects the housing bore 10 extends into a further coaxially disposed bore 11 of smaller diameter.

The last named bore 11 serves to accommodate a bolt 12 which is threaded into a nut 13 in an enlarged end region of the bore 11 in such a way that a wider shaft region 12' of the bolt 12 is fixedly braced against a ring element 14 which is disposed in an annular step-like recess in the transition region between the housing bore 10 and the further bore 11. The wider shaft region 12' of the bolt 12 passes through an axial bore in the bevel gear 5 and serves to radially journal the bevel gear 5, while the ring element 14 and the head 12" of the bolt 12 cooperate to form an axial bearing for the bevel gear 5.

A coil spring 15 is arranged inside the sleeve formed by the bevel gear 5 and by the shaft part 8, with the coil spring being braced at its end adjacent the bevel gear 5 on an annular step inside the sleeve and with its other end being biased against a plate part 16. This plate part 16 comprises an inner plate part 16' which forms the movable spring abutment for the coil spring 15 and also a ring-like outer plate part 16" which is arranged inside a recess 17 of circular cross-section in the knob-like handle 4 which is radially journalled on the axle part 8. The inner and outer plate parts 16' and 16" are connected with one another via webs which extend through axial slots 18 which are open up to the free end of the axle part 8. In this way the plate part 16 is non-rotatably but axially displaceably arranged relative to the axle part 8.

Latch-like recesses or radial slots 19 are arranged in the outer plate part 16" and cooperate with latch balls 20. These latch balls are pushed by the plate part 16 under the bias of the coil spring 15 against a ring-like counter-pressure plate 21 which is secured to the free end of the axle part 8 and cooperates with an annular step at the transistion between the shaft part 8 and the ring-like thickened portion 9 in order to axially mount the knob-like handle 4.

A ring part 22 which consists of two pieces of sheet metal is rotatably journalled between the plate part 16 and the counter-pressure plate 21 on the axle part 8 and accommodates the balls 20 in the manner of a ball cage in slots 22' which are open in the radially outward direction. Radial projections 23 are provided at the periphery of the ring part 22 which extend into associated axial slots in the peripheral wall of the recess 17 of the knob-like handle 4 in such a way that the ring part 22 and the knob-like handle 4 are coupled to one another so that relative rotation cannot take place If the latch balls 20 are located inside the latch recesses or radial slots 10 of the plate 16 as shown in FIG. 3 then the knob-like handle 4 is latched via the ball cage-like ring part 22 which is non-rotatably coupled thereto, via the latch balls 20 and also via the plate part 16 which is non-rotatable relative to the axle part 8, with the axle part 8, and also with the bevel gear 5 arranged thereon, so that the bevel gear 5 rotates on rotating the handle 4 and drives the spindle 2 via the bevel gear 6.

If an excessive load is present, for example when the glazed door or window sash has reached a closed position and the handle 4 is nevertheless still rotated in the direction of this end position, then the plate part 16 can move against the bias of the spring 15 so that the latch balls 20 no longer cooperate with the latch recesses or radial slots 19 in the plate part 16 and the latching is released. This makes it possible to avoid incorrect actuation of the handle 4 resulting in impermisibly high positioning forces being exerted on the positioning linkage of the door or window sash which is coupled with the slider 3, which could lead to destruction of parts of the fitting or adjustment mechanism.

As can be seen from FIGS. 1 and 2 the housing 1 has a cover 24 with a window 25 through which the position of the slider 3 can be seen. Symbols arranged on the window 25 show the respectively associated position of the glazed sash.

At one end the cover 24 is secured to the housing in as much as a step-like angle portion 26 arranged at the cover 24 engages beneath a corresponding cut-out on the housing 1. At the other end the cover 24 has a similar step-like angle portion 27 which cooperates with the nose of a slider-like retaining member 28. The slider-like retaining member 28 can be adjusted by means of a positioning screw 29 which is accessible excessible via an opening 30 in the cover 24. The positioning screw 29 engages in a bore at the housing 1 which is connected with the bore 11 which accommodates the bolt 12. In this way the positioning screw 29 is braced against the bolt 12 when the holding member 28 is braced from the inside against the cover 24 and simultaneously acts to prevent rotation of the bolt 12.

On the whole the gear mechanism of the invention is characterised by its extremely compact construction because the housing 1 essentially only needs to accommodate the spindle 2 and also the slider 3, and all remaining elements are arranged in or on the knob-like handle 4.

The inclined position of the handle 4 relative to the plane of the glazed sash ensures that the periphery of the handle 4 is arranged on the side adjacent the central region of the frame at the lower side of the housing which faces away from the central region of the frame. Accordingly the gear mechanism of the invention can also be housed, if necessary, in the corner regions which are formed by the plane of the frame and also by the constructional components which adjoin the door or window frame.

Although the adjustment mechanism of the present invention is particularly intended for use with tiltable glazed sashes it is also more generally applicable to any other form of tiltable panel-like member.

We claim:

1. An adjustment mechanism for tiltable glazed sashes of windows and doors and the like, the adjustment mechanism comprising a housing (1) mountable on a frame part associated with a glazed sash, a spindle (2) arranged in said housing, a slider arranged on said spindle, said slider being moveably disposed on said spindle and displaceable upon rotation of said spindle and being operable to be coupled to the glazed sash to tilt the same, a first gear wheel (6) rotatably fixedly connected with said spindle at an end thereof, a second gear wheel (5) in mesh with said first gear wheel and rotatably journalled in said housing, a knob-like rotatable handle (4) for rotating said spindle, said handle being journalled on a stub-like axle element (8) which is rotatably fixedly connected with said second gear wheel, said axle element being constructed as a hollow sleeve, there being a coil spring (15) operable as a latch spring arranged inside said sleeve, a plate part (16) which is axially displaceable and non-rotatably arranged relative to said sleeve, said plate part having a first portion (16") surrounding the sleeve in ring-like manner and being connected via web parts which extend through axial slots (18) provided in the sleeve with a second portion (16') of the plate part which is disposed inside the sleeve and which forms a movable abutment for the spring, said spring being braced against an annular step in said sleeve and biased against said movable abutment, latch elements (19) arranged on the first portion (16") of said plate part, and counter elements (20) on said knob-like handle (4) and a part (22) connected therewith, and a latch mechanism (15 to 23) cooperating with said part (22) and operating as an overload coupling arranged inside said knob-like handle, said stub-like axle element being drivingly connected with said knob-like handle by said latch mechanism, whereby rotation of said handle causes rotation of said spindle and displacement of said slider. .

2. An adjustment mechanism in accordance with claim 1, characterised in that an outwardly pivotable crank handle (7) is mounted on said knob-like handle (4).

3. An adjustment mechanism in accordance with claim 1, characterised in that said knob-like handle (4) has an axis of rotation which is inclined towards the central region of said housing in such a way that the contour of the knob-like handle (4) is disposed, when viewed at right angles to the plane of said housing.

4. An adjustment mechanism in accordance with claim 1, characterised in that said knob-like handle (4) is arranged at one end of said housing (1) adjacent an end face of said spindle (2).

5. An adjustment mechanism in accordance with the claim 1, characterised in that said second gear wheel (5) is radially journalled, by means of a central bore which extends therethrough, on a bolt (12) arranged in said housing (1) and also at its side facing said axle element (8), by means of a circular thickened portion (9) in a housing bore (10).

6. An adjustment mechanism according to claim 1, characterized in that said latch elements comprise latch recesses (19) and said counter elements comprise balls (20) arranged in recesses (22') of said part (22) connected with said knob-like handle (4), said last names part (22) being annular and constructed as a ball cage and being rotatably arranged in said handle.

7. An adjustment mechanism in accordance with claim 6, characterised in that the balls (20) are biased against a counter-pressure plate (21) which is held on the axle element (8) to axially secure the knob-like handle (4).

8. An adjustment mechanism in accordance with claim 7, characterised in that said axle element (8) has a circular thickened portion (9) disposed in a bore (10) of said housing (1), and said knob-like handle (4) is axially journalled between said circular thickened portion (9) and the counter-pressure plate (21).

* * * * *